US007597629B2

(12) United States Patent
Laijoki-Puska

(10) Patent No.: US 7,597,629 B2
(45) Date of Patent: Oct. 6, 2009

(54) METHOD AND ARRANGEMENT FOR PRODUCING EXPERIENCES

(76) Inventor: Ritva Laijoki-Puska, Visamäki 5 E 37, Espoo (FI) FI-02130

( * ) Notice: Subject to any disclaimer, the term of this patent is extended or adjusted under 35 U.S.C. 154(b) by 68 days.

(21) Appl. No.: 11/399,369

(22) Filed: Apr. 7, 2006

(65) Prior Publication Data

US 2006/0247066 A1 Nov. 2, 2006

Related U.S. Application Data

(63) Continuation of application No. PCT/FI2004/000588, filed on Oct. 6, 2004.

(30) Foreign Application Priority Data

Oct. 7, 2003 (FI) ..... 20031467

(51) Int. Cl.
*A63J 5/02* (2006.01)
*A63J 5/00* (2006.01)

(52) U.S. Cl. ..... 472/65; 472/130

(58) Field of Classification Search ..... 472/57–61, 472/65, 130, 136; 52/1, 2.22
See application file for complete search history.

(56) References Cited

U.S. PATENT DOCUMENTS 4,790,531 A 12/1988 Matsui et al.
5,322,035 A * 6/1994 Hawes et al. ..... 119/227
5,377,458 A * 1/1995 Dempster ..... 52/1
5,407,392 A 4/1995 Laijoki-Puska et al.
6,172,814 B1 1/2001 Watanabe et al.
6,262,840 B1 7/2001 Watanabe et al.
6,301,845 B1 * 10/2001 Milanian ..... 52/236.1
6,319,136 B1 11/2001 Laijoki-Puska et al.
6,488,590 B2 * 12/2002 Katayama ..... 472/90

FOREIGN PATENT DOCUMENTS

| | | |
|---|---|---|
| CN | 1197937 | 11/1998 |
| CN | 1325475 | 12/2001 |
| EP | 470085 | 2/1992 |
| WO | WO-00/28174 | 5/2000 |
| WO | WO-02/092942 | 11/2002 |

* cited by examiner

*Primary Examiner*—Kien T Nguyen
(74) *Attorney, Agent, or Firm*—Birch, Stewart, Kolasch & Birch, LLP

(57) ABSTRACT

The present invention relates to a method for producing experiences, wherein a person (3) is brought, within boundaries (1, 4) to be the object of artificial climatological and/or seasonal conditions, wherein the person at the same time has the possibility to encounter different separate activities and/or meet different conditions or creations. Of these at least a part are based on artificially generated solid and/or semi-solid elements or structures (9, 10, 12, 13, 14, 15, 19, 19') associated with refrigeration of water. The present invention also relates to an arrangement for generating experiences, where there is at least one space (2) which can be secluded. Said space includes arrangements (9, 10, 11, 12, 13, 14, 15, 16, 19, 19') which present different climates and/or seasons in real-time and at least partially three-dimensionally, by means of which certain artificial elements (9, 10, 11, 14, 15, 22) can be observed by the person (3) in order to form a comprehensive three-dimensional experience. The present invention also relates to the use of the method and the arrangement.

18 Claims, 1 Drawing Sheet

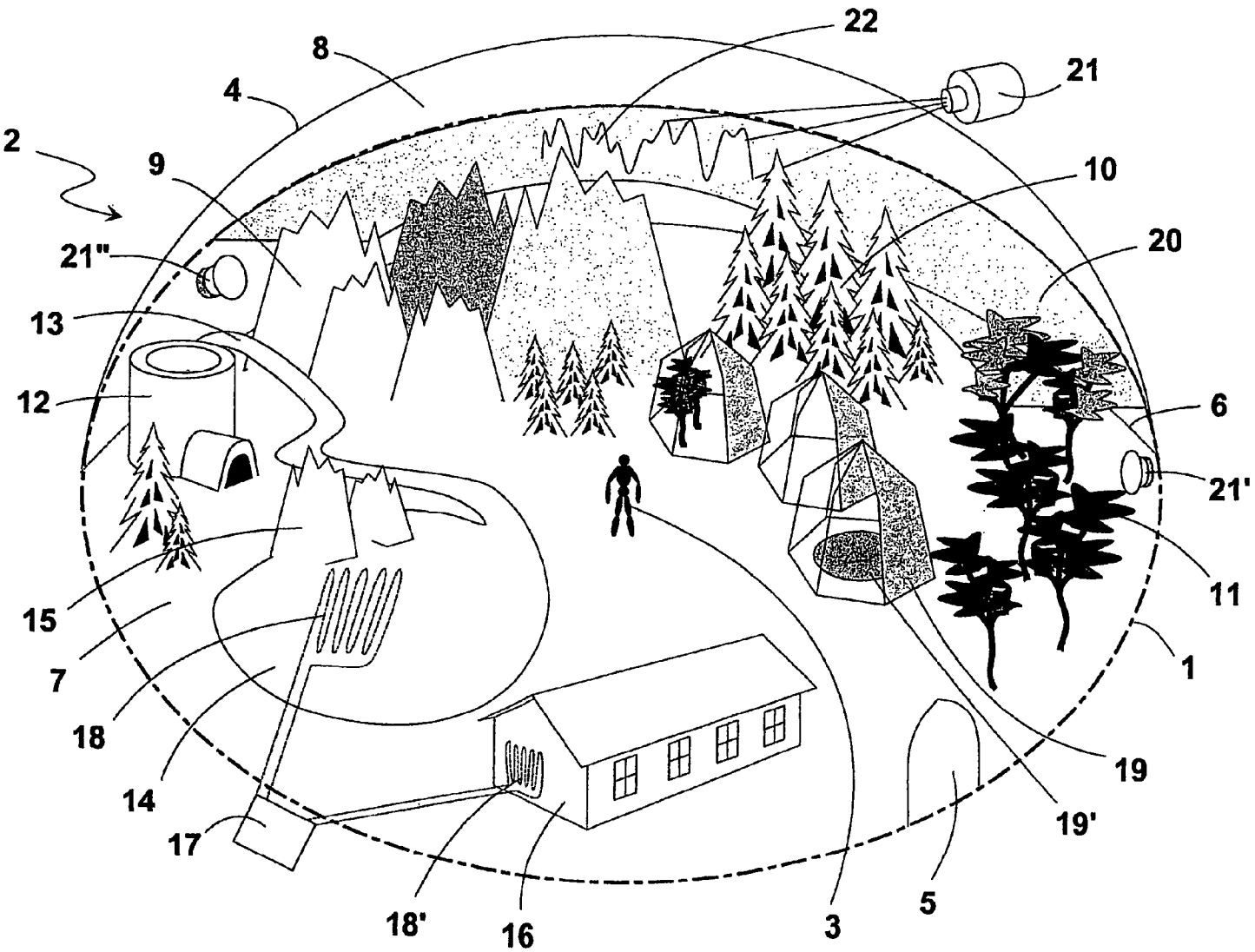
1
2
3
4
5
6
7
8
9
10
11
12
13
14
15
16
17
18
18'
19
19'
20
21
21'
21"
22

METHOD AND ARRANGEMENT FOR PRODUCING EXPERIENCES

The present invention relates to a method and an arrangement for producing experiences, especially so that the person or group of persons constituting the object of the experience is subjected to certain impulses.

A person will have the feeling of encountering an experience especially when having the possibility to meet or getting into a situation where she/he meets conditions which differ from those of normal life. Usually an experience is a positive thing, but the nature of an experience can also include, as one element, a situation where the person experiences a certain degree of danger, threat, fear or pleasure or some other exceptional situation differing from the secure everyday life. In order to encounter such an experience it is, especially for an urban person, generally enough that such situations are induced under controlled circumstances which feel safe.

Typically, one tends to arrange situations which produce experiences as a part of leisure, tourism or entertainment or as an enlivening element in context with some more factual event. A teaching or educational process is also especially effective, when capable of inducing a feeling of experience for the student.

The object of the present invention is to disclose a method and an arrangement by means of which experiences related especially to Nordic or Arctic conditions are produced, and especially so that interaction between different states of aggregation of water are utilized as one element.

The method according to the present invention is characterized by bringing a person subjected to encounter an experience, to constitute the subject for such arctic conditions that are artificially formed within boundaries and/or especially boundary surfaces which are essentially closed, closable or at least can be clearly defined, in order to render it possible for said person to encounter a comprehensive experience, in such a way that the person himself within the same context can experience various separate arctic activities and/or meet different conditions or creations, wherein said activities, conditions or creations at least to a significant extent are based on artificially created solid and/or semi-solid elements or structures which relate to the freezing of water.

In a physical sense this means arranging such demarcated conditions within which one can produce and at least temporarily maintain frost or at least such conditions that are required for freezing water to ice.

Correspondingly, the arrangement for producing experiences according to the present invention includes spaces located within boundaries which are favorably essentially confined or which can be closed, to which spaces people have access, said spaces including arrangements which depict different climates and/or seasons in real-time and at least partially three-dimensionally, by means of which arrangements certain artificial climatological elements and/or elements connected to a season can be observed at different distances so that a comprehensive three-dimensional experience is formed.

The appended FIGURE schematically discloses how a person is brought within closed boundary surfaces such as a common building which covers the whole arrangement, an administratively closed group of buildings, a system of caves or, e.g., a ground area closed off by a fence, where he will be subjected to several impacts evoking a comprehensive experience.

In the FIGURE, an area or space 2 is shown by means of a boundary 1 indicated by a phantom line, where a person 3 is schematically shown in the center. The words "area" and "space" should here be broadly interpreted to comprise all conditions that can be defined by a border which is present physically or mentally, i.e. mainly imaginative. Such a space can have a physical roof/wall structure which fully or partially defines the space, as the cupola 4 which is allusively shown in the FIGURE, or the space can be defined mainly by allusive definitions. The entry and exit of the space 2 lead through one or several openings 5, which can be physical openings or merely an imaginary means of passage. The border of the space does not necessarily attach to any physically perceivable border, structure or arrangement, and the expression also covers a situation where the boundaries of the space at the same time define both an area and its corresponding airspace 8 or an underground space related to the area, as long as these at least mentally can be perceived as pertaining to the space defined by the boundaries. Thus, a thin phantom line within the boundaries 1 shows a real or imaginary horizon line 6 which within the space constitutes a border between a surface 7 and an airspace 8.

Despite the fact that the word "space" thus can be interpreted in a rather abstract way a favorable embodiment of the present invention, however, is usually based on that said space 2 is closed off or can be closed in such a way that some requirements related mainly to commercial or social exploitation are set to give access to the space. As a general example of this kind of space which as such is defined in a physical sense the spatial arrangement according to the applicant's earlier international patent application No. PCT/FI99/00934 can be mentioned.

According to the present invention one or several persons 3 dwelling in this kind of secluded space 2, which also as such may be a passage leading to another space or area, is brought to encounter a comprehensive experience so that the person 3 himself will have the possibility to meet with several separate activities related to climate and/or season of the year and/or the diurnal rhythm. In the FIGURE some activities of this kind are disclosed in an exemplifying manner, such as suitably an Arctic mountain landscape 9, Nordic wood landscapes 10 and 11, a snow castle structure 12 to which a snowy slope 13 usable for skiing is connected which suitably ends on a field 14 imitating, e.g., the icy surface of a lake, at the edge of which there are disclosed elements of art and/or elements 15 influencing the nature of the atmosphere in the space 2.

The FIGURE further discloses, in a schematic manner, a number of separate spaces which are arranged within the defined space 2. Such separate spaces, for example a building arranged for functions such as restaurants, shows, entertainment, education, accommodation, service or the like can have resemblance to a traditional Nordic residential building, or it can be some other structure having an appropriate architecture. Favorably, the arrangement is such that the heating of the building 16 utilizes heat from the refrigeration of some other element, e.g., a ice field 14 as disclosed in the FIGURE, in which case a machinery 17 or some other arrangement serving, e.g., a heat exchange or some other maintenance functions, or some other arrangement such as refrigerating and heating apparatus 18, 18' can be located completely or partially within said defined space 2 or outside thereof.

Separate spaces arranged within said defined space may include spaces 19 arranged for other functions, within which spaces different functions connected to the personal comprehensive experience for a person 3 inside the defined space 2. As examples of such separate spaces can be mentioned the spatial arrangements known from the applicant's earlier international patent application No. PCT/FI02/00408, according to which for example a water basin 19' adapted for spa functions can be arranged in this kind of spaces.

According to the present invention the produced personal experiences relate especially to the utilization of phenomena related to freezing of water and melting of ice, whereby the structures which contribute to the experiences favorably at least partially are formed as a result of refrigeration and heating functions directed to water. As a consequence an experience which is produced in accordance with the present invention will be especially associated with Arctic or at least cold conditions and with events and phenomena which occur under such conditions, which does not bar the fact that a temperature or some other conditions generally prevailing in a space may correspond to the temperature and the conditions in some other part of the world. As such, an experience is a rather subjective matter, and the forming thereof depends, besides on the persons inner character and, correspondingly, external influences for which he is the subject, also on the general atmosphere within the space and other sometimes rather abstract influences. By artificially maintaining mutually contrary conditions where a warm space has cold elements, or vice versa, an effect is generated which improves the encounter of an overall experience.

Especially, according to one embodiment of the present invention, different structures related to water are utilized for generating the comprehensive experience. Such structures, of which the decorations referred to as 15 are only one example, are formed as subjects related to Arctic conditions so that water, water mist and/or steam is refrigerated below the freezing point of water, suitably so that the energy which is set free by the refrigeration 18 at the same time is used for heating special structures 16 which are located within said boundary surfaces. Special arrangements for generating such structures are disclosed in the applicant's earlier patent EP-0 470 085 and U.S. Pat. No. 6,319,136.

Besides structures based on changing the state of aggregation of water favorably also other phenomena which occur in nature under arctic conditions or relate to such conditions, and/or artificial phenomena resembling or imitating such phenomena, are formed within the boundaries 4 of said structures 2 comprehensively or as separate operations. Thus, for example, in a forest landscape 10 and/or 11 one can artificially or naturally produce conditions which depict the different seasons, such as snow cowering the ground in winter, melting of the snow and the effervescence of streams in spring, the whistle of grass and bird's singing in summer, a windy rainy day in autumn, etc. In the same manner, by means of suitable growing one can cause the color of the leaves of certain trees and bushes to change in a way which imitates the phenomena of Nordic forest glowing in the autumn.

According to an especially favorable embodiment some part or the space, for example an area connecting to the vicinity of the artificial horizon 6 and rising up towards the sky, is provided with a reflector surface 20, onto which by means of a projector 21 located within the space or outside thereof some images 22 which have an impact on the overall experience, of which images the FIGURE discloses a phenomena which imitates Northern lights. For such a reflector surface a glass structure is favorably used where the glass as such has a structure which regarding its properties such as transparency can be artificially influenced. By projecting images on a background of physically existing elements and structures, which images present an "extension" of the structure, an impression is generated which to a person 3 looking at the physical structure may seem to extend into infinity. This impact is based on the effect that a person 3 who looks at a physical object which is near him will attach his main attention expressly to the physically existing, whereby an image structure behind the object and in the background will have less attention while at the same time still contributing to the instinctively formed comprehensive observation and thus also to the personally encountered experience.

Such projected structures 22 can be static as well as dynamic. Typical static structures may comprise, e.g., landscapes and trees, while dynamic structures may present such phenomena as the sun's rising, progress and setting, the progress of the moon and stars, Northern lights as disclosed under reference 22 in the FIGURE, etc. As a complement acoustical effects are suitably generated in the space 2 by means of appropriate apparatus 21', such effects here being considered as belonging to dynamic structures or dynamic functions, which further may include even such elements like sledge riding. The FIGURE further discloses a snow cannon 23" for generating artificial snow, by means of which snow cannon a blanket of artificial snow is generated or maintained on locations where this improves the forming of the experience. For clarity, such machines and devices have been omitted in the FIGURE which, e.g., the maintenance of a ski slope 13 possibly would require.

The above described static and dynamic structures or other phenomena which, as such, would be associated with nature or normal human life, or matters of which at least a part already due to their nature may associate to Arctic conditions or to prevailing ideas thereof, contribute to an improvement and diversification of the effect of experience which especially a low temperature evokes in the mind and feelings of a human being.

The method and arrangement according to the present invention are favorably used in conditions where the Arctic world as such is regarded as distant, unknown, mythical or even dangerous. Especially, the present invention can be utilized as an element in tourist, catering, entertainment or educational arrangements open to a limited group of people or to the public.

Above the present invention has been described in an exemplifying manner in the form of some embodiments, but for the professional it is clear that the invention can be realized also in many other ways within the scope of the appended claims.

The invention claimed is:

1. A method for producing, within definable boundaries, experiences including encountering artificially generated solid or semi-solid elements or structures associated with refrigeration of water, comprising the steps of:

bringing one or several persons to dwell within definable boundaries, said one or several persons dwelling are faced within said definable boundaries with artificially generated climatologically or seasonally based conditions or both;

rendering said one or several persons to encounter, one at a time, different conditions or creations, wherein at least a part of said experiences, said conditions or said creations are based on said artificially generated elements or structures of which at least a part are generated as a result of the refrigeration of the water or a heating of the water;

forming said structures as subjects related to arctic conditions so that the water, water mist, or steam, or a combination thereof, are refrigerated to under a freezing temperature of the water, and concurrently using energy which is released due to the refrigeration for heating separate objects which functionally relate to arrangements for producing the experiences, thereby providing a comprehensive three-dimensional experience by simultaneously rendering an individual one of the persons to be an object, within one and a same general context, of several separate ones of the experiences or views related to climate or a season of a year or both.

2. A method as defined in claim 1, wherein in addition to producing the experiences by the structures based on a change of the state of aggregation of the water, other phenomena which naturally occur in arctic conditions or relate to the arctic conditions, or artificial phenomena which resemble or imitate said arctic conditions, the method further comprising the step of:

suitably generating experiences within said definable boundaries, either comprehensively or as separate functions, by an impact of a low temperature, static or dynamic effects, or functions which have an impact on human minds or feelings of the persons dwelling within said definable boundaries.

3. A method as defined in claim 2, further comprising the step of:

using, as dynamic functions, functions which are adapted for the arctic conditions and which are otherwise known and associated with normal human life.

4. A method as defined in claim 3, further comprising the step of:

using, as dynamic or static functions or both, images which are projected on a surface located behind said elements or said structures, the images being adaptable to the climate or the season or a diurnal rhythm which is associated one of the elements in a front of the definable boundaries.

5. A method as defined in claim 3, wherein the arrangements are related to leisure, tourism, catering, entertainment or education for a defined group or the persons or for public groups.

6. A method as defined in claim 2, further comprising the step of:

using, as dynamic or static functions or both, images which are projected on a surface located behind said elements or said structures, the images being adapted or adaptable to the climate, or the season, or a diurnal rhythm which is associated one of the elements in a front of the definable boundaries.

7. A method as defined in claim 2, further comprising the step of:

using, as extra effects, phenomena or matters which are associated with nature or common human life, or phenomena or matters which are associated with a nature of arctic conditions or with prevailing ideas regarding the arctic conditions.

8. A method as defined claim 2, wherein the arrangements are related to leisure, tourism, catering, entertainment or education for a defined group or the persons or for public groups.

9. A method as defined in claim 1, further comprising the step of:

using, as extra effects, phenomena or matters which are associated with nature or common human life, or phenomena or matters associated with a nature of arctic conditions, or with prevailing ideas regarding the nature of the arctic conditions.

10. A method as defined in claim 9, further comprising the step of:

using, as dynamic functions, functions which are adapted for the arctic conditions but which are otherwise known and associated with normal human life.

11. A method as defined in claim 9, further comprising the step of:

using, as dynamic or static functions or both, images which are projected on a surface located behind said elements or said structures, the images being adaptable to the climate or the season or a diurnal rhythm which is associated one of the elements in a front of the definable boundaries.

12. A method as defined in claim 9, wherein the arrangements are related to leisure, tourism, catering, entertainment or education for a defined group or the persons or for public groups.

13. A method as defined in claim 1, wherein the arrangements are related to leisure, tourism, catering, entertainment or education for a defined group or the persons or for public groups.

14. A method as defined in claim 1, wherein in addition to producing experiences by an impact of a low temperature with the structures based on a change of the state of aggregation of the water, other phenomena which naturally occur in arctic conditions or relate to the arctic conditions, or artificial phenomena which resemble or imitate the arctic conditions within said definable boundaries, the method further comprising the step of:

generating, comprehensively or as separate functions, static or dynamic effects or functions which have an impact on human minds or feelings of the persons within said definable boundaries.

15. A method as defined in claim 1, further comprising the step of:

using, as extra effects, phenomena or matters which are associated with nature or common human life, or phenomena or matters which are associated with a nature of arctic conditions or with prevailing ideas regarding the arctic conditions.

16. An arrangement for producing experiences within definable boundaries, comprising:

at least one essentially closed space having a definable boundary to which one or several persons have access, a plurality of elements located within the definable space, the elements being adapted to depict different climates, or seasons, or both in real-time at least partially three-dimensionally, said elements being arranged in such a manner that certain climatological or seasonally associated conditions, at least partially generated as a result of refrigeration or heating functions related to water, form structures as subjects related to arctic conditions so that the water, water mist, or steam, or a combination thereof, are refrigerated to under a freezing temperature of the water, and concurrently use energy which is released due to the refrigeration for heating separate objects which functionally relate to the arrangement for experiences, wherein the structures are observable by said persons at different distances so that a comprehensive three-dimensional experience is formed in minds of the persons dwelling within the definable boundaries.

17. An arrangement as defined in claim 16, wherein, in addition to said three-dimensional elements included in the at least one space, the at least one space also includes two-dimensional elements generated by means of projection and which are arranged suitably as imagined extensions of said three-dimensional elements.

18. An arrangement as defined in claim 17, wherein said two-dimensional elements are projected on a base which is at least partially transparent, or has a transparency or reflection density, or a combination thereof, and which can be changed, the base being located as an extension of said three-dimensional elements in a position that is either behind or over said three-dimensional elements.

* * * * *